US012357066B2

(12) United States Patent
Mitchell

(10) Patent No.: US 12,357,066 B2
(45) Date of Patent: Jul. 15, 2025

(54) SKATEBOARD CONTAINER

(71) Applicant: Concept Infiniti LLC, Aurora, CO (US)

(72) Inventor: Marcus Duayne Mitchell, Aurora, CO (US)

( * ) Notice: Subject to any disclaimer, the term of this patent is extended or adjusted under 35 U.S.C. 154(b) by 342 days.

(21) Appl. No.: 18/145,137

(22) Filed: Dec. 22, 2022

(65) Prior Publication Data

US 2024/0206608 A1 Jun. 27, 2024

(51) Int. Cl.

| | |
|---|---|
| ***A45C 5/14*** | (2006.01) |
| ***A45C 11/00*** | (2006.01) |
| ***A45C 13/00*** | (2006.01) |
| ***A45C 13/02*** | (2006.01) |
| ***A45C 13/26*** | (2006.01) |
| ***A63C 17/00*** | (2006.01) |

(52) U.S. Cl.

CPC ..... *A45C 5/14* (2013.01); *A45C 11/00* (2013.01); *A45C 13/005* (2013.01); *A45C 13/02* (2013.01); *A45C 13/262* (2013.01); *A63C 17/002* (2013.01); *A45C 2013/267* (2013.01)

(58) Field of Classification Search

CPC ..... A45C 5/14; A45C 13/005; A45C 13/02; A45C 13/262; A45C 2013/267; A45C 11/00; A45C 13/002; A45C 2003/007; A45C 2003/008; A45C 5/00; A63C 17/002; B60R 9/00; B60R 9/055

USPC ..... 206/315, 315.1; 211/85.7; 224/533, 310

See application file for complete search history.

(56) References Cited

U.S. PATENT DOCUMENTS

| | | | | |
|---|---|---|---|---|
| 3,193,124 | A * | 7/1965 | Essling | B60R 9/042 224/310 |
| 3,366,295 | A * | 1/1968 | Nygaard | B60R 9/055 224/325 |
| 4,344,646 | A * | 8/1982 | Michel | E05B 65/5276 292/87 |
| 5,167,306 | A * | 12/1992 | Carrigan, Jr. | A45C 13/262 190/115 |
| 5,435,423 | A | 7/1995 | Rekuc et al. | |
| 5,749,447 | A * | 5/1998 | Hersh | A45C 13/40 190/111 |
| 6,095,385 | A * | 8/2000 | Utu | A45C 5/14 224/628 |
| 6,367,603 | B1 * | 4/2002 | Tiramani | E05B 65/5276 190/115 |
| 6,530,507 | B2 * | 3/2003 | Oh | A45C 5/14 224/653 |

(Continued)

*Primary Examiner* — Nathan J Jenness
*Assistant Examiner* — Jennifer Castriotta
(74) *Attorney, Agent, or Firm* — MP Patents, LLC

(57) ABSTRACT

A container for a skateboard includes a housing, at least one strut, at least one wheel and at least one handle. The housing has a front panel, a rear panel, a bottom panel and first and second side panels surrounding a primary compartment. A top panel is pivotably coupled with the rear panel to selectively open the primary compartment to surroundings. The at least one strut is operatively coupled between the top panel and the housing. The at least one wheel is provided to an exterior of the first and/or second side panels near a corner formed by the rear panel meeting the bottom panel and is rotatable about an axis normal with the first and/or second side panels. The at least one handle telescopes along the bottom panel towards and away from the front panel.

18 Claims, 8 Drawing Sheets

(56) References Cited

U.S. PATENT DOCUMENTS

| | | | | |
|---|---|---|---|---|
| 7,144,070 | B2 * | 12/2006 | Wiebe | B60R 9/055 296/183.1 |
| 7,644,810 | B2 * | 1/2010 | Duncan | A63C 17/0006 190/1 |
| 9,714,044 | B2 * | 7/2017 | Taylor | A45F 3/04 |
| 10,626,654 | B2 * | 4/2020 | Logan | E05F 1/105 |
| 2021/0000235 | A1 | 1/2021 | Osseiran | |
| 2024/0132183 | A1 * | 4/2024 | Brataas | A45F 3/04 |

* cited by examiner

SKATEBOARD CONTAINER

TECHNICAL FIELD

The disclosure relates to a container, and in particular, to a storage, suitcase, valise or trunk intended to assist an individual in carrying items while travelling.

SUMMARY

The disclosure describes a container for a skateboard. The container includes a housing, at least one strut, at least one wheel and at least one handle. The housing has a front panel, a rear panel, a bottom panel and first and second side panels surrounding a primary compartment. A top panel is pivotably coupled with the rear panel to selectively open the primary compartment to surroundings. The at least one strut is operatively coupled between the top panel and the housing. The at least one wheel is provided to an exterior of the first and/or second side panels near a corner formed by the rear panel meeting the bottom panel and is rotatable about an axis normal with the first and/or second side panels. The at least one handle telescopes along the bottom panel towards and away from the front panel.

The skateboard storage system includes a housing, at least one wheel, at least one handle, a frame and a rack mounting bracket. The housing has a front panel, a rear panel, a bottom panel and first and second side panels surrounding a primary compartment. A top panel is pivotably coupled with the rear panel to selectively open the compartment to surroundings. The at least one wheel is provided to an exterior of the first and/or second side panels near a corner formed by the rear panel meeting the bottom panel and is rotatable about an axis normal with the first and/or second side panels. The at least one handle telescopes along the bottom panel towards and away from the front panel. The frame is provided to an exterior surface of the bottom panel and includes a tongue. The rack mounting bracket has a groove configured to receive the tongue.

BRIEF DESCRIPTION OF THE FIGURES

The summary above, as well as the following detailed description of illustrative embodiments, is better understood when read in conjunction with the appended drawings. For the purpose of illustrating the present disclosure, example constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

DETAILED DESCRIPTION

Figure 1:
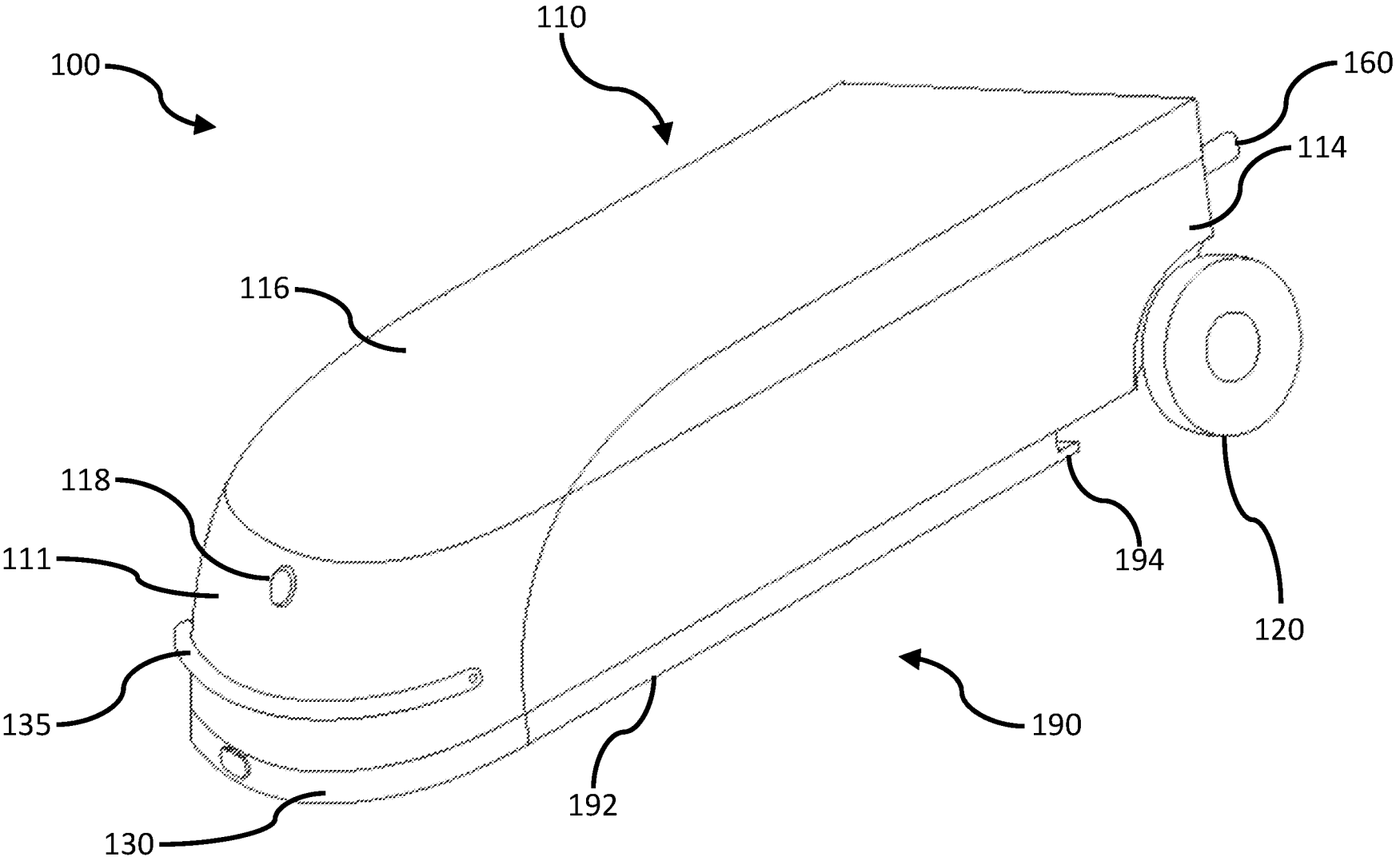
FIG. 1 illustrates a perspective view of an example skateboard container.
Figure 2:
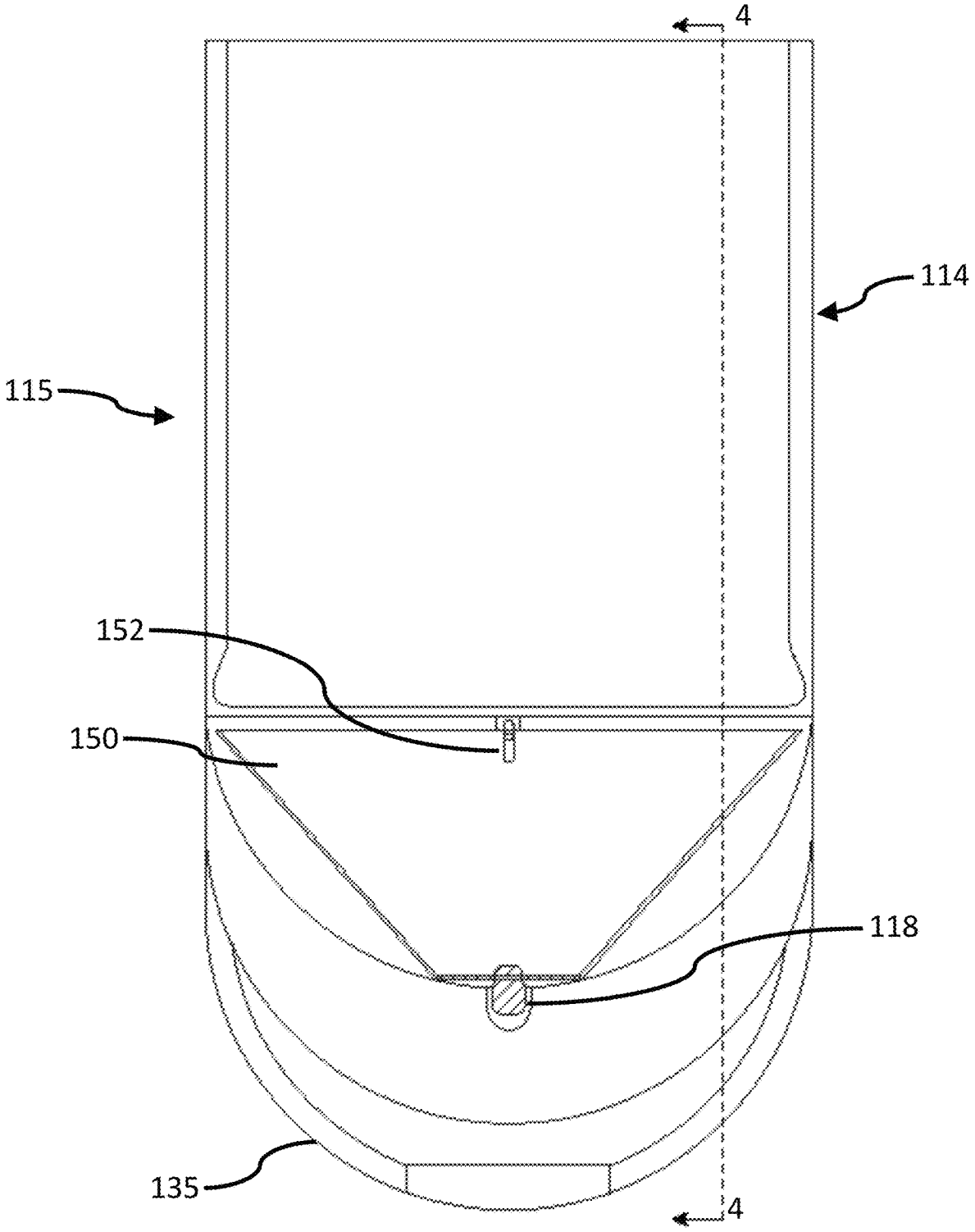
FIG. 2 illustrates a top view of the skateboard container of FIG. 1 with a top panel pivoted to an open configuration and housing an example skateboard.

The following detailed description illustrates embodiments of the present disclosure and manners by which they can be implemented. Although the best mode of carrying out the present disclosure has been disclosed, those skilled in the art would recognize that other embodiments for carrying out or practicing the present disclosure are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Skateboards are often bulky and obtrusive making them difficult to transport, in particular, on planes, trains, busses, motorcycles and bicycles. The mounting of the wheels to trucks which space the wheels from the skateboard deck cause skateboards to have an irregular shape. Free-rolling wheels make skateboards susceptible to rolling away from the traveller which is annoying and could be hazardous to the traveller or fellow travelers.

Embodiments of the present disclosure provide a container suitable for transport of a skateboard or other wheeled platform such as a caster board, vigorboard, waveboard, slalomboard, scooter or self-balancing scooter.

Embodiments of the present disclosure substantially eliminate, or at least partially address, problems in the prior art, enabling a user to transport a skateboard or similar easily in a more regular, less obtrusive form which also isolates the wheels from environmental surfaces. Additional aspects, advantages, features and objects of the present disclosure will be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

FIGS. 1-7 illustrate an example skateboard container 100. Container 100 includes a housing 110, at least one wheel 120 partially housed by at least one wheel well 125, at least one handle 130 and at least one strut 140.

Figure 3:
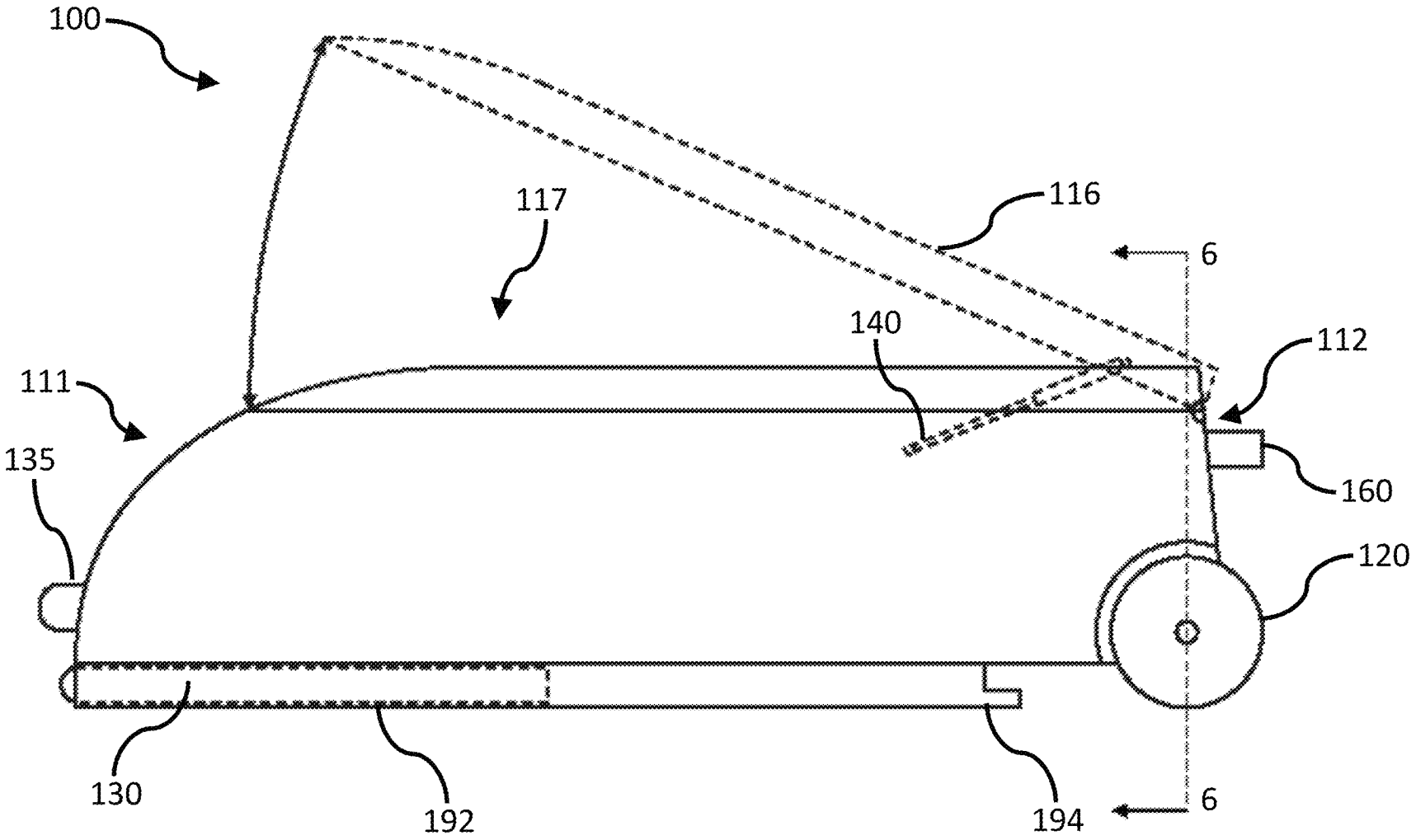
FIG. 3 illustrates a side view of the skateboard container of FIGS. 1 & 2.
Figure 4:
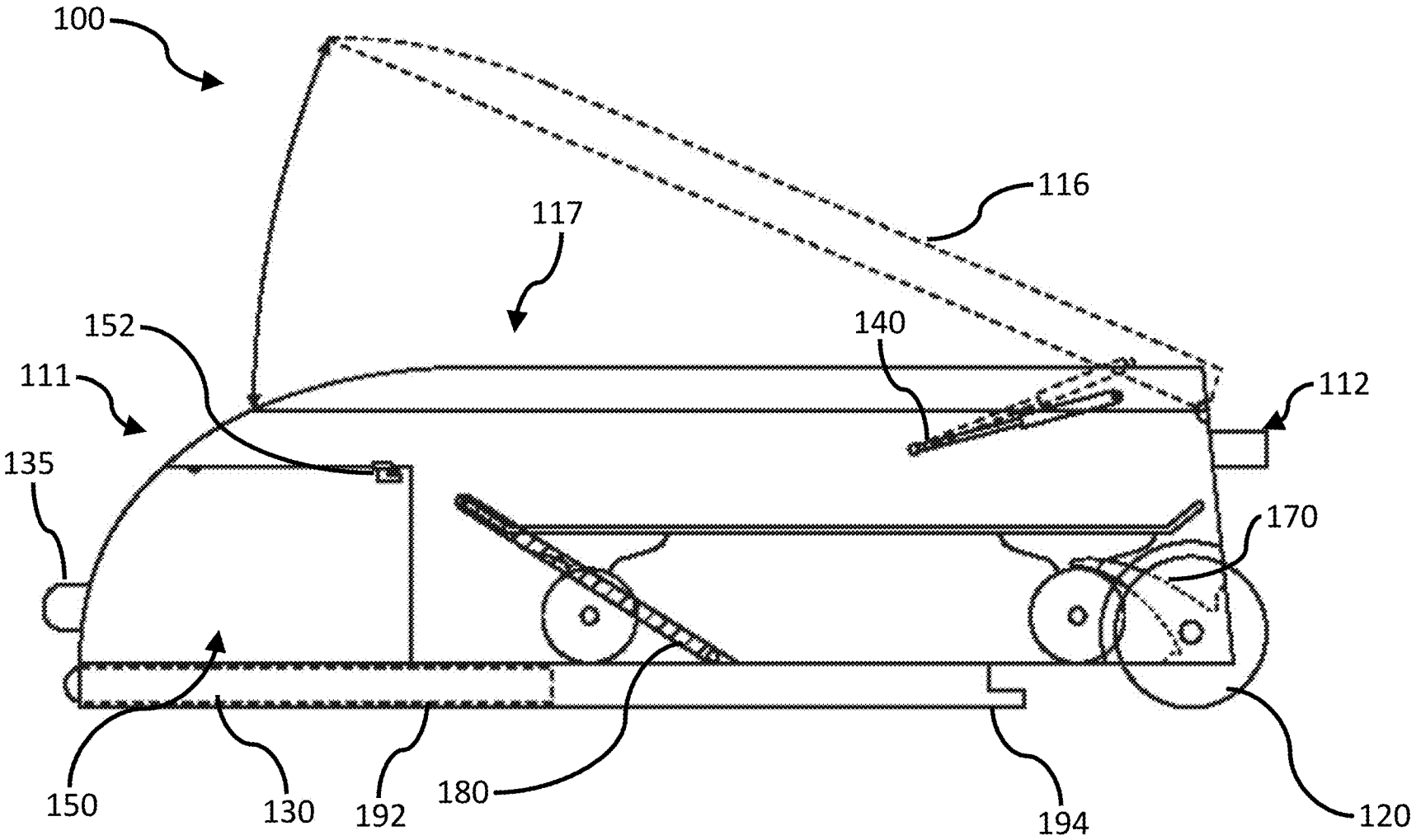
FIG. 4 illustrates a sectional side view of the skateboard container of FIGS. 1-3 along plane 4-4 of FIG. 2.
Figure 5:
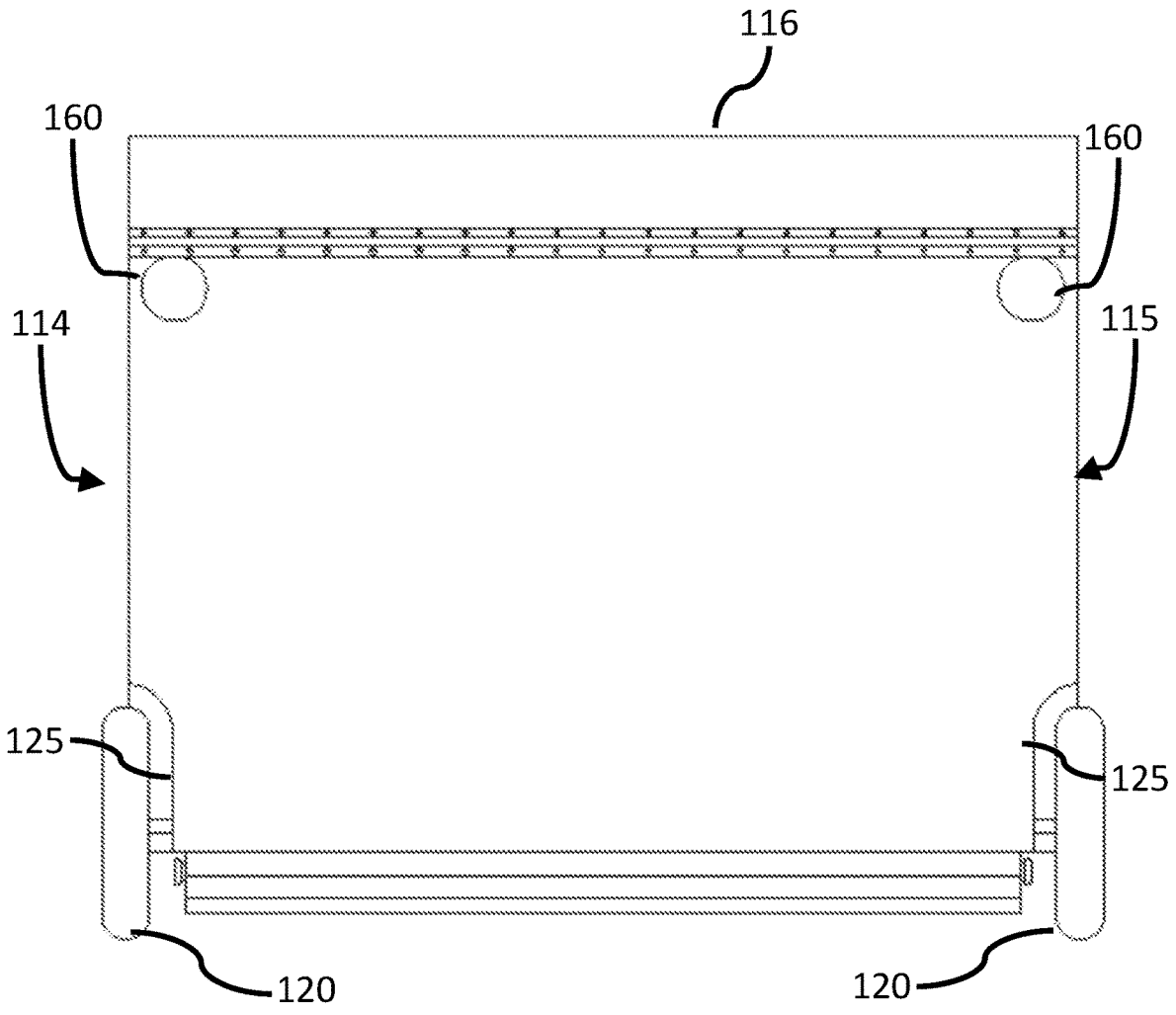
FIG. 5 illustrates a rear view of the skateboard container of FIGS. 1-4.
Figure 6:
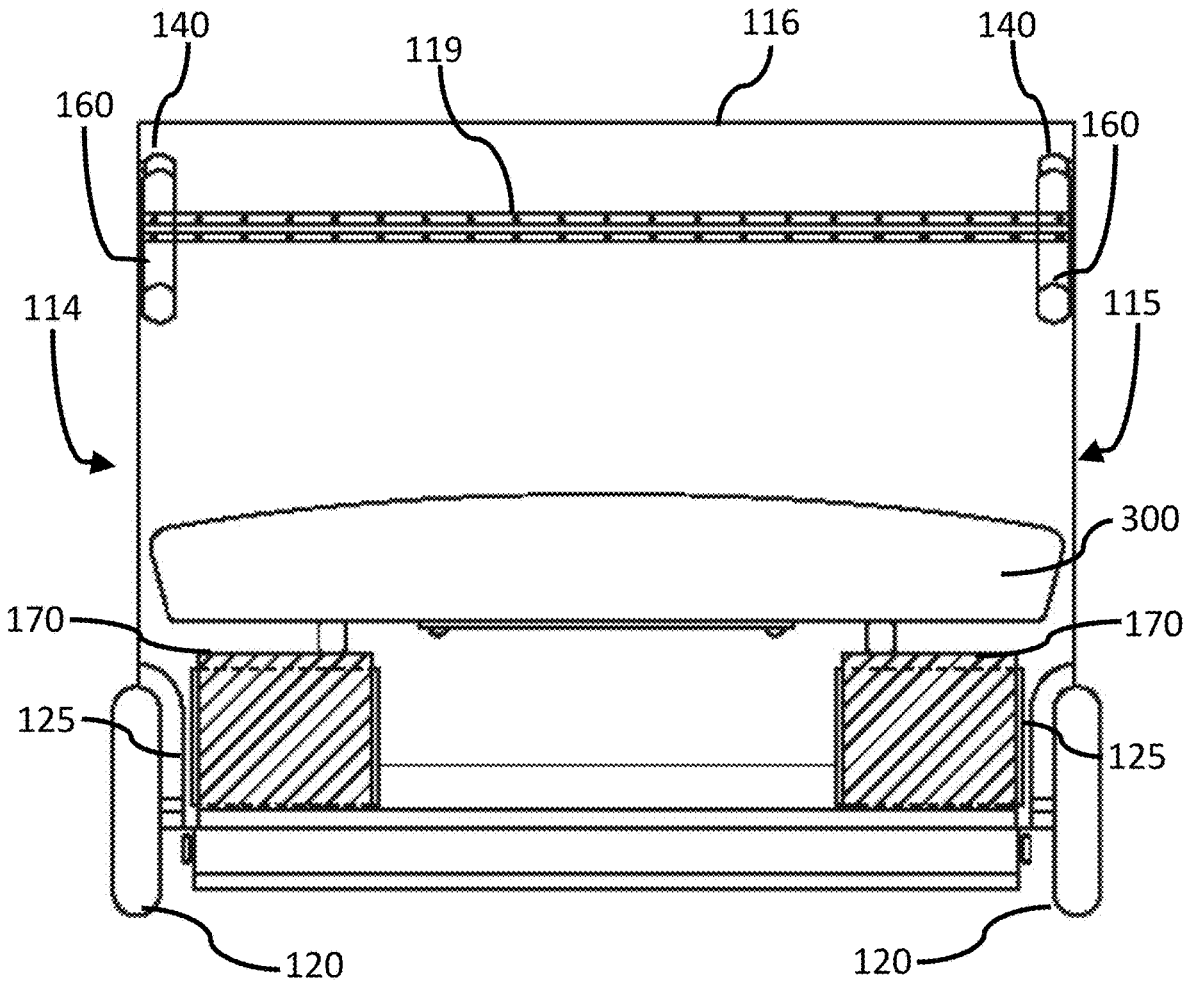
FIG. 6 illustrates a rear sectional view of the skateboard container of FIGS. 1-5 along plane 6-6 of FIG. 3.
Figure 7:
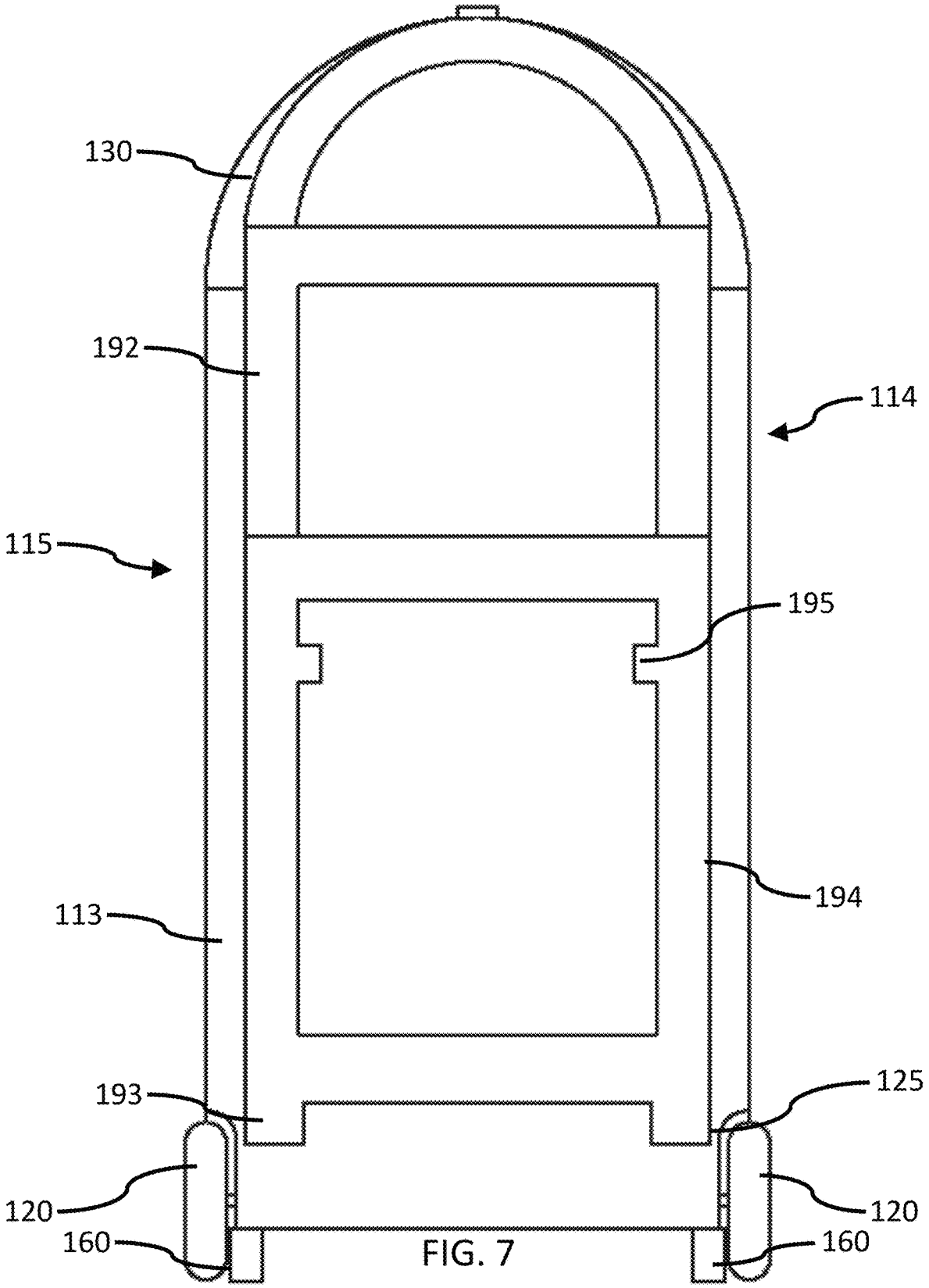
FIG. 7 illustrates a bottom view of the skateboard container of FIGS. 1-6.

Housing 110 has a front panel 111, a rear panel 112, a bottom panel 113 and first 114 and second 115 side panels surrounding a primary compartment 117 (FIG. 3). A top panel 116 is pivotably coupled with rear panel 112 by a hinge 119 to selectively open primary compartment 117 to surroundings.

Front panel 111 smoothly transitions into top panel 116 along a curvature. A nose formed from the bottom and front panels may be rounded, from first side panel 114 to second side panel 115 about a radius of curvature generally normal to bottom panel 113. Skateboard container 100 may further include a carpet lining primary compartment 117.

While container 100 and the associated panels may take any of a variety of dimensions suitable for containing a skateboard 300 for transport, in an example, front panel 111 has the approximate dimensions of 9.25"×7.5", rear panel 112 has the approximate dimensions of 9.25"×7.5", bottom panel 113 has the approximate dimensions of 36"×9.25" and the first and second side panels have the approximate dimensions of 36"×7.5".

While container 100 may be formed from any of a variety of durable, substantially rigid, weather-resistant materials, in an example, the panels of housing 110 include at least one polycarbonate plastic.

The at least one wheel 120 is provided to an exterior of the first and/or second side panels near a corner formed by rear panel 112 meeting bottom panel 113 and is rotatable about an axis normal with the first and/or second side panels. In an example, container 100 includes two wheels 120 which are countersunk with the side panels enabled by curved wheel wells 125.

The at least one strut 140 is operatively coupled between top panel 116 the housing 110. Strut 140 controls pivoting of top panel 116. When container 100 is oriented with the bottom generally horizontal, strut 140 assists opening of top panel 116 and slows closing thereof whereas when container 100 is oriented with the bottom generally vertical, strut 140 slows opening of top panel 116 and assists closing thereof. In an example, two struts 140 are provided with one on either side of primary compartment 117.

A push button 118 may be provided to front panel 111 and be configured to release top panel 116 from the closed position, for example, by actuating a latch away from a tab of top panel 116.

The at least one handle 130 telescopes along bottom panel 113 towards and away from front panel 111. In an example, telescoping handle 130 reaches 14" in length. Container 100 may further include a stationary handle 135 provided to the front panel 111.

Container 100 may further include at least one wheel chock 170 fixed in primary compartment 117 near the corner formed by rear panel 112 meeting bottom panel 113. In an example, wheel chock 170 takes the form of a broad hook extending within primary compartment 117 from the corner formed by rear panel 112 meeting bottom panel 113. In a further example, two wheel chocks 170 are provided with one near a first side panel 114 and the other provided near a second side panel 114.

The system may further include a strap 180 anchored to bottom panel 113 in primary compartment 117. Strap 180 is configured to wrap, loop around or otherwise grip the nose of a skateboard and cooperates with wheel chock 170 to secure the skateboard within container 100. In an example, strap 180 is elastic and is stretched to grip the nose of the skateboard.

Skateboard container 100 may further include at least one stabilizing foot 160 provided to rear panel 112 adjacent to the pivotable coupling 119 of top panel 116 to rear panel 112. The at least one stabilizing foot 160 extends from rear panel 112 a distance about equal to the distance the at least one wheel 120 protrudes from rear panel 112 so that container 100 may be balanced between wheel 120 and stabilizing foot 160 with the bottom and top generally vertical. In an example, container 100 includes two stabilizing feet 160.

Container 100 may further include, between front panel 111 and rear panel 112, a secondary compartment 150 with a hinged closure. Secondary compartment 150 may be suitable for containing various accessories or personal items such as tools, snacks and/or charging devices. The hinged closure of secondary compartment 150 may be selectively held in the closed position with a latch 152. The hinged closure of the secondary compartment 150 may pivot from a closed position to an open position in a direction opposite the pivot direction of top panel 116.

Container 100 may further include a frame 190 provided to an exterior surface of bottom panel 113. Frame 190, which may be provided as a boxed mount 192 and a thin plate 194, includes a tongue 193 configured for receipt within a groove of a mounting bracket 200. Additionally or alternatively, frame tongue 193 provides for mortise and tenon joinery with a mounting bracket. Container 100 may further include several mounting tabs 195 projecting from thin plate 194.

Figure 8:
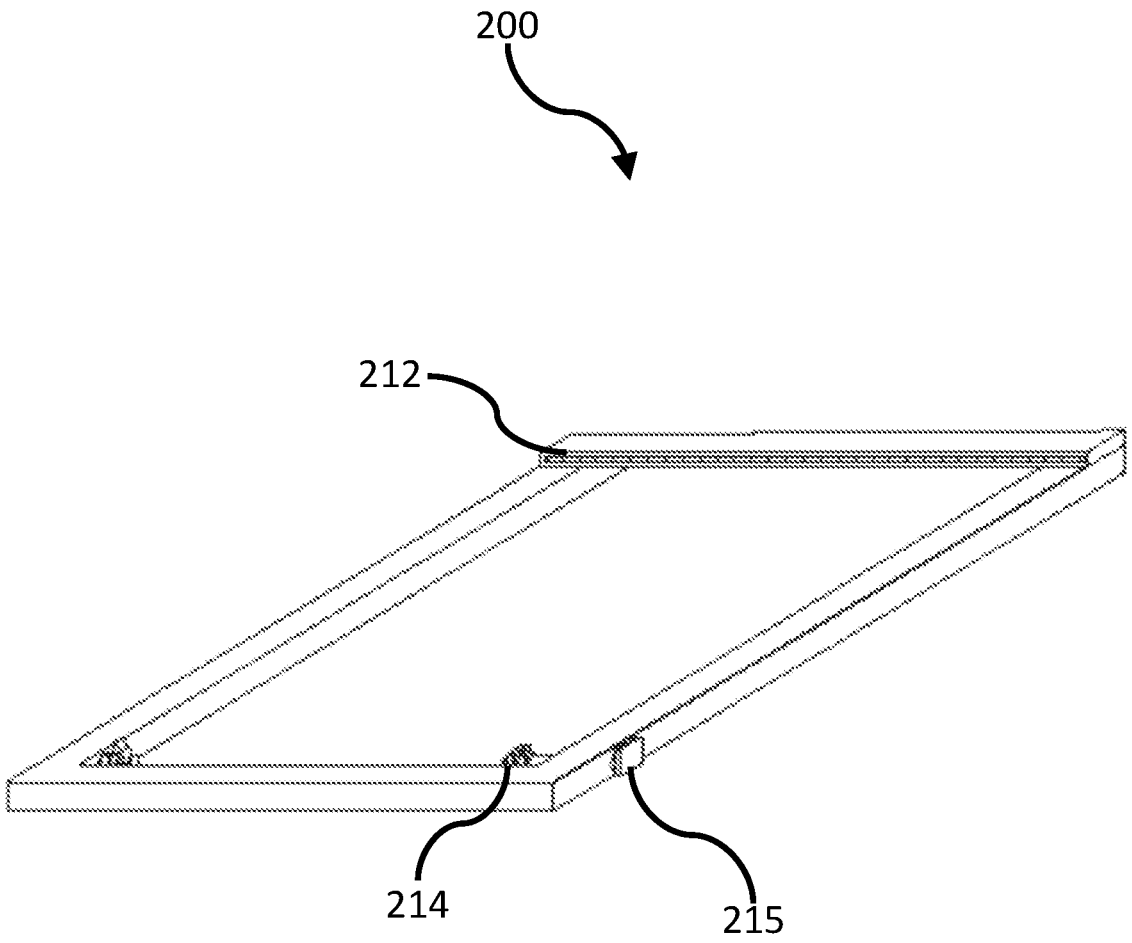
FIG. 8 illustrates a perspective view of an example rack mounting bracket suitable for use in association with the skateboard container of FIGS. 1-7.

Container 100 may find use as part of a skateboard storage system in association with a rack mounting bracket 200 for coupling with a vehicle such as a luggage rack of a bicycle, motorbike or automobile. FIG. 8 illustrates a perspective view of an example rack mounting bracket suitable for use in association with disclosed skateboard containers. Rack mounting bracket 200 has a groove 212 configured to receive tongue 193. Rack mounting bracket 200 may further include a latch 214 configured for engaging with mounting tabs 195 of frame 190 to, in cooperation with tongue 193 and groove 212, selectively lock container 100 to mounting bracket 200. Buttons 215 are configured to actuate latches 214 to release tabs 195 from the grip thereof.

Disclosed containers and storage systems may be useful in any of a variety of methods for transporting a skateboard which methods include a set of steps or actions.

An example method includes, with a bottom panel and/or frame of a housing resting on a support surface, pivoting a top panel coupled with a rear panel of the housing to open a primary compartment to surroundings. Pivoting the top panel may be performed under the guidance and/or control of at least one strut operatively coupled between the top panel and the housing. Prior to pivoting the top panel, a button may be pushed to release the top panel from being held in the closed position.

A skateboard is placed into the primary compartment such that the skateboard deck is generally parallel with the top and bottom panels. At least one wheel of the skateboard is gripped between an interior surface of the bottom panel and a wheel chock extending within the primary compartment towards a front panel from a corner formed by the rear panel meeting the bottom panel. A strap anchored to the bottom panel in the primary compartment is stretched and placed around the nose of the skateboard.

A secondary compartment provided between the front panel and the rear panel may be opened by pivoting a closure on a hinge so that one or more skateboard accessories may be placed in the secondary compartment. The closure may then be pivoted to close the secondary compartment to contain the accessories. The top panel is pivoted into contact with the front panel and first and second side panels such that the primary compartment is closed to surroundings. Closure of the front panel may be selectively maintained with a button-activated latch.

The housing is pivoted on at least one wheel provided to an exterior of the first and/or second side panels near a corner formed by the rear panel meeting the bottom panel from a recumbent orientation to an upright orientation. A telescoping handle is extended along the bottom panel away from the front panel. Extending the telescoping handle away from the front panel may further include pushing a release button on the handle. The housing may be tilted into an oblique-angled orientation and pulled such that it rolls on the at least one wheel. After arriving at a destination, the telescoping handle may be pushed to retract along the bottom panel towards the front panel. The housing may be lifted by a stationary handle provided to the front panel.

If the destination is a location of a bicycle, motorbike or automobile, a frame provided to an exterior surface of the bottom panel may be coupled with a mounting bracket provided to a luggage rack of the bicycle, motorcycle or automobile. The frame may be coupled with the mounting bracket by inserting a tongue of the frame into a groove of the mounting bracket. Additionally or alternatively, the frame may be coupled with the mounting bracket by inserting a tenon of the frame into a mortise of the mounting bracket. Further, a number of mounting tabs of the frame may be aligned with latches of the mounting bracket and the frame pressed against the mounting bracket until the latches engage the mounting tabs and hold the frame to the mounting bracket.

When the bicycle, motorcycle or automobile arrives at its destination a number of buttons may be pushed to disengage the latches from the mounting tabs. The frame may then be lifted away from the mounting bracket.

The actions described above with reference to a method for transporting a skateboard are only illustrative and other alternatives can also be provided where one or more actions are added, one or more actions are removed, or one or more actions are provided in a different sequence without departing from the scope of the claims herein.

Embodiments of the present disclosure are susceptible to being used for various purposes, including, though not limited to transport of a skateboard or other wheeled platform such as a caster board, vigorboard, waveboard, slalomboard, scooter or self-balancing scooter in an unobtrusive and convenient manner on planes, trains, busses, motorcycles and bicycles.

Modifications to embodiments of the present disclosure described in the foregoing are possible without departing from the scope of the present disclosure as defined by the accompanying claims. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

What is claimed is:

1. A container for a skateboard, comprising:

a housing having a front panel, a rear panel, a bottom panel and first and second side panels surrounding a primary compartment and a top panel pivotably coupled with the rear panel to selectively open the primary compartment to surroundings;

at least one strut operatively coupled between the top panel and at least one of the first and second side panels of the housing;

provided to an exterior of the first and/or second side panels near a corner formed by the rear panel meeting the bottom panel, at least one wheel rotatable about an axis normal with the first and/or second side panels;

at least one handle telescoping along the bottom panel towards and away from the front panel; and at least one wheel chock secured in the primary compartment near a corner formed by the rear panel meeting the bottom panel.

2. The container as set forth in claim 1, wherein the front panel smoothly transitions into the top panel along a curvature.

3. The container as set forth in claim 1, further comprising a strap anchored to the bottom panel in the primary compartment.

4. The container as set forth in claim 1, further comprising a push button provided on the front panel and configured to release the top panel from a closed position.

5. The container as set forth in claim 1, further comprising a stationary handle provided on the front panel.

6. The container as set forth in claim 1, further comprising at least one stabilizing foot provided on the rear panel adjacent to a coupling of the top panel to the rear panel.

7. The container as set forth in claim 1, further comprising a frame provided on an exterior surface of the bottom panel.

8. The container as set forth in claim 7, wherein the frame provides a tongue configured for receipt within a groove of a mounting bracket.

9. The container as set forth in claim 7, wherein the frame provides a tenon configured for receipt within a mortise of a mounting bracket.

10. The container as set forth in claim 7, wherein the frame further comprises a plurality of mounting tabs configured for engaging a latch of a rack mounting bracket.

11. The container as set forth in claim 1, further comprising, inaccessible while the top panel is pivoted closed, a secondary compartment with a hinged closure.

12. The container as set forth in claim 11, wherein the hinged closure of the secondary compartment pivots from a closed position to an open position in a direction opposite the pivot direction of the top panel.

13. A skateboard storage system, comprising:

a housing having a front panel, a rear panel, a bottom panel, first and second side panels surrounding a primary compartment and a top panel pivotably coupled with the rear panel to selectively open the primary compartment to surroundings;

provided to an exterior of the first and/or second side panels near a corner formed by the rear panel meeting the bottom panel, at least one wheel rotatable about an axis normal with the first and/or second side panels;

at least one handle telescoping along the bottom panel towards and away from the front panel;

a frame provided on an exterior surface of the bottom panel and including a tongue;

a rack mounting bracket having a groove configured to receive the tongue; and at least one hook extending within the primary compartment from a corner formed by the rear panel meeting the bottom panel.

14. The system as set forth in claim 13, further comprising a strap anchored to the bottom panel in the primary compartment.

15. The system as set forth in claim 13, further comprising at least one stabilizing foot provided to the rear panel adjacent to a coupling of the top panel to the rear panel.

16. The system as set forth in claim 13, further comprising a plurality of mounting tabs projecting from the frame.

17. The system as set forth in claim 16, wherein the rack mounting bracket further comprises a plurality of push-button latches configured for engaging the mounting tabs.

18. A container for a skateboard, comprising:

a housing having a front panel, a rear panel, a bottom panel and first and second side panels surrounding a primary compartment and a top panel pivotably coupled with the rear panel to selectively open the primary compartment to surroundings;

at least one strut operatively coupled between the top panel and at least one of the first and second side panels of the housing;

provided to an exterior of the first and/or second side panels near a corner formed by the rear panel meeting the bottom panel, at least one wheel rotatable about an axis normal with the first and/or second side panels;

at least one handle telescoping along the bottom panel towards and away from the front panel; and at least one hook extending within the primary compartment from a corner formed by the rear panel meeting the bottom panel.

* * * * *